US009123493B2

(12) United States Patent
Rogers

(10) Patent No.: US 9,123,493 B2
(45) Date of Patent: Sep. 1, 2015

(54) MICROELECTROMECHANICAL SWITCHES FOR STEERING OF RF SIGNALS

(71) Applicant: HARRIS CORPORATION, Melbourne, FL (US)

(72) Inventor: John E. Rogers, Gainesville, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 14/161,784

(22) Filed: Jan. 23, 2014

(65) Prior Publication Data

US 2015/0206686 A1 Jul. 23, 2015

(51) Int. Cl.
*H01H 51/22* (2006.01)
*H01H 59/00* (2006.01)

(52) U.S. Cl.
CPC ..... *H01H 59/0009* (2013.01)

(58) Field of Classification Search
CPC ..... H01H 59/0009
USPC ..... 335/78
See application file for complete search history.

(56) References Cited

U.S. PATENT DOCUMENTS 5,536,988 A 7/1996 Zhang et al.
5,959,516 A 9/1999 Chang et al.
6,127,767 A * 10/2000 Lee et al. ..... 310/309
6,133,670 A 10/2000 Rodgers et al.
6,310,526 B1 * 10/2001 Yip et al. ..... 333/262
6,360,033 B1 3/2002 Lee et al.
6,497,141 B1 12/2002 Turner et al.
6,611,168 B1 8/2003 Denison et al.
6,621,390 B2 * 9/2003 Song et al. ..... 335/78
6,661,069 B1 12/2003 Chinthakindi et al.
6,853,534 B2 2/2005 Williams (Continued)

FOREIGN PATENT DOCUMENTS

EP 1760731 3/2007
EP 1 785 391 A2 5/2007

(Continued)

OTHER PUBLICATIONS

Information about Related Patents and Patent Applications, see section 6 of the accompanying Information Disclosure Statement Letter, which concerns Related Patents and Patent Applications. (Jan. 29, 2015).

(Continued)

*Primary Examiner* — Alexander Talpalatski
(74) *Attorney, Agent, or Firm* — Robert J. Sacco, Esq.; Fox Rothschild LLP

(57) ABSTRACT

A switch includes a shuttle having an elongated length resiliently supported at opposing ends thereof and configured to move along a motion axis in response to an applied voltage. A shuttle switch portion includes a plurality of shuttle contact fingers extending transversely from opposing sides of the shuttle. A common contact at a common terminal side of the shuttle includes a plurality of contact fingers respectively interdigitated with the shuttle contact fingers. First and second terminal contacts are adjacent a switched terminal side of the shuttle, and include first terminal contact fingers and second terminal contact fingers respectively interdigitated with shuttle contact fingers. The shuttle switch portion is configured to selectively connect the common contact to the first terminal contact or the second terminal contact.

25 Claims, 8 Drawing Sheets

(56) References Cited

U.S. PATENT DOCUMENTS

| | | | | |
|---|---|---|---|---|
| 6,975,193 | B2 * | 12/2005 | Knieser et al. | 335/78 |
| 7,012,489 | B2 | 3/2006 | Sherrer et al. | |
| 7,091,647 | B2 | 8/2006 | Jerman | |
| 7,148,772 | B2 | 12/2006 | Sherrer et al. | |
| 7,251,466 | B2 | 7/2007 | Porret et al. | |
| 7,304,556 | B2 | 12/2007 | Tamura et al. | |
| 7,598,836 | B2 | 10/2009 | Lee | |
| 7,732,975 | B1 * | 6/2010 | Hobbs et al. | 310/309 |
| 7,755,174 | B2 | 7/2010 | Rollin et al. | |
| 7,858,422 | B1 | 12/2010 | Quevy et al. | |
| 7,898,356 | B2 | 3/2011 | Sherrer et al. | |
| 7,933,112 | B2 | 4/2011 | Ayazi et al. | |
| 7,977,136 | B2 | 7/2011 | Ayazi et al. | |
| 8,039,922 | B2 | 10/2011 | Ni | |
| 8,276,259 | B1 | 10/2012 | Findley et al. | |
| 8,373,522 | B2 * | 2/2013 | Rogers | 333/197 |
| 8,860,114 | B2 | 10/2014 | Yen et al. | |
| 8,900,994 | B2 | 12/2014 | Yu et al. | |
| 2001/0001550 | A1 | 5/2001 | Bryzek et al. | |
| 2002/0130586 | A1 | 9/2002 | Mao et al. | |
| 2003/0020561 | A1 * | 1/2003 | Qiu et al. | 333/105 |
| 2003/0102936 | A1 * | 6/2003 | Schaefer | 333/105 |
| 2003/0155221 | A1 * | 8/2003 | Kawai | 200/43.01 |
| 2003/0184413 | A1 | 10/2003 | Nguyen | |
| 2004/0104449 | A1 | 6/2004 | Yoon et al. | |
| 2004/0189142 | A1 | 9/2004 | Knieser et al. | |
| 2005/0073380 | A1 | 4/2005 | Howell et al. | |
| 2005/0088255 | A1 | 4/2005 | Sengupta et al. | |
| 2005/0264384 | A1 * | 12/2005 | Simon et al. | 335/78 |
| 2006/0003482 | A1 | 1/2006 | Chinthakindi et al. | |
| 2006/0087390 | A1 * | 4/2006 | Yuba et al. | 335/78 |
| 2006/0238279 | A1 | 10/2006 | Lu et al. | |
| 2006/0261702 | A1 | 11/2006 | Harada et al. | |
| 2008/0157627 | A1 | 7/2008 | Kato et al. | |
| 2009/0058569 | A1 | 3/2009 | Sherrer et al. | |
| 2009/0114513 | A1 * | 5/2009 | Kim et al. | 200/181 |
| 2010/0091372 | A1 | 4/2010 | Yamanoi et al. | |
| 2011/0102105 | A1 * | 5/2011 | Rogers | 333/186 |
| 2011/0148525 | A1 | 6/2011 | Herrera | |
| 2011/0188168 | A1 | 8/2011 | Rogers | |
| 2011/0198202 | A1 * | 8/2011 | Rogers | 200/181 |
| 2011/0204969 | A1 | 8/2011 | Chen et al. | |
| 2013/0049888 | A1 | 2/2013 | Ruby | |
| 2013/0194770 | A1 | 8/2013 | Bernstein et al. | |
| 2013/0285171 | A1 | 10/2013 | Najafi et al. | |
| 2013/0328140 | A1 | 12/2013 | Potasek et al. | |
| 2015/0048901 | A1 | 2/2015 | Rogers | |
| 2015/0048902 | A1 | 2/2015 | Rogers | |
| 2015/0048903 | A1 | 2/2015 | Rogers | |

FOREIGN PATENT DOCUMENTS

| | | | |
|---|---|---|---|
| EP | 1973190 | | 9/2008 |
| WO | 0007218 | | 2/2000 |
| WO | 02/080279 | | 10/2002 |
| WO | 03055061 | A1 | 7/2003 |
| WO | 2008123525 | A1 | 10/2008 |
| WO | 2010054889 | A1 | 5/2010 |
| WO | 2011053888 | | 5/2011 |
| WO | 2011097093 | | 8/2011 |

OTHER PUBLICATIONS

International Search Report and Written Opinion mailed Oct. 7, 2011, in Application PCT/US2011/022483.

International Search Report and Written Opinion issued Mar. 5, 2012, in Application PCT/US2011/023321.

International Search Report and Written Opinion issued Nov. 18, 2014, in Application No. PCT/US2014/049668.

International Search Report and Written Opinion mailed Nov. 18, 2014, in Application PCT/US2014/049667.

International Search Report and Written Opinion mailed Oct. 31, 2014, in Application PCT/US2014/049664.

Bunch, R.L. et al., "Quality Factor and Inductance in Differential IC Implementations," IEEE Microwave Magazine, vol. 3, No. 2, Jun. 1, 2002, pp. 82-92.

Fedder, G.K., "Tunable RF and Analog Circuits Using on-Chip MEMS Passive Components"; 2005 IEEE International Solid-State Circuits Conference, ISSCC 2005, Feb. 9, 2005, Digest of Technical Papers, pp. 390-391.

Harris Corporation, International Search Report dated Mar. 16, 2011; Application Serial No. PCT/US2010/054889.

Huang, T. et al., "5-GHz Low Phase-Noise CMOS VCO Integrated with a Micromachined Switchable Differential Inductor," IEEE Microwave and Wireless Components Letters, IEEE Service Center, New York, NY, US, vol. 18, No. 5, May 1, 2008, pp. 338-340.

Leblond, H. et al., "On-Chip Spiral Inductors and Metal-Air-Metal Capacitors in Suspended Technology," 2006 European Microwave Conference, Sep. 1, 2006, pp. 44-47.

Legtenberg, R. et al., "Comb-Driven actuators for Large Displacement," J. of Micromechanics and Microengineering, vol. 6, pp. 320-329, 1996.

Rogers, John E., et al.: "Bi-Directional Gap Closing MEMS Actuator Using Timing and Control Techniques", IEEE Industrial Electronics, IECON 2006—32nd Annual Conference on, IEEE, Piscataway, NJ, USA, Nov. 1, 2006, pp. 3149-3154, XP031077518.

Tas N.R., et al.: "Technical Note; Design, Fabrication and Test of Laterally Driven Electrostatic Motors Employing Walking Motion and Mechanical Leverage" Journal of Micromechanics & Microengineering, Institute of Physics Publishing, Bristol, GB, vol. 13, No. 1, Jan. 1, 2003, pp. N6-N15, XP020068883.

Yalcinkaya, A.D., "Low Voltage High-Q SOI MEMS Varactors fro RF Applications"; 2003 IEEE Proceedings of the 29th European Solid-State Circuits Conference, ESSCIRC '03, Sep. 16-18, 2003, pp. 607-610, with one IEEE Xplore abstract page.

* cited by examiner

MICROELECTROMECHANICAL SWITCHES FOR STEERING OF RF SIGNALS

BACKGROUND OF THE INVENTION

1. Statement of the Technical Field

The inventive arrangements relate to micro-electro-mechanical systems (MEMS) and methods for forming the same, and more specifically to bi-directional switches for RF signals.

2. Description of the Related Art

Switched filter architectures are common in many communication systems to discern desired signals in various bands of interest. These switched filter architectures have switch requirements such as low loss and high isolation over a wide range of frequencies (e.g. 1 MHz to 6.0 GHz). Miniaturized switches such as monolithic microwave integrated circuit (MMIC) and MEMS switches are commonly used in broadband communications systems due to stringent constraints imposed on the components of such systems (such as size, power and weight (SWaP)).

Three-dimensional microstructures can be formed by utilizing sequential build processes. For example, U.S. Pat. Nos. 7,012,489 and 7,898,356 describe methods for fabricating coaxial waveguide microstructures. These processes provide an alternative to traditional thin film technology, but also present new design challenges pertaining to their effective utilization for advantageous implementation of various devices such as miniaturized switches.

SUMMARY OF THE INVENTION

Embodiments of the invention concern a switch. The switch includes first and second opposing base members formed on a substrate. First and second resilient members are provided respectively at the first and second opposing base members. A shuttle having an elongated length extends over the substrate and is resiliently supported at opposing first and second ends thereof by the first and second resilient members respectively. An drive portion is configured to selectively move the shuttle along a motion axis aligned with the elongated length in response to an applied voltage. The drive portion includes a shuttle drive portion provided at a first location along the elongated length including a plurality of shuttle drive fingers extending transversely from opposing sides of the shuttle. The drive portion also includes a plurality of motive drive fingers interdigitated with the plurality of shuttle drive fingers. The motive drive fingers are fixed with respect to the substrate and disposed on opposing sides of the shuttle drive portion of the shuttle.

A shuttle switch portion is provided at a second location along the elongated length of the shuttle. The shuttle switch portion is electrically isolated from the shuttle drive portion and from the first and second opposing base members. The shuttle switch portion includes a first switch element formed of a first plurality of shuttle contact fingers extending transversely from opposing sides of a first switch section of the shuttle. The shuttle switch portion also includes a second shuttle switch element formed of a second plurality of shuttle contact fingers extending transversely from opposing sides of a second switch section of the shuttle. A common contact is provided which has a fixed position relative to the substrate and is disposed on a common terminal side of the shuttle. The common contact includes a first and second plurality of common contact fingers respectively interdigitated with the first plurality of shuttle contact fingers and the second plurality of shuttle contact fingers.

First and second terminal contacts are fixed on a portion of the substrate adjacent to a switched terminal side of the shuttle. The first and second terminal contacts include first terminal contact fingers and second terminal contact fingers respectively, which are respectively interdigitated with the first plurality of shuttle contact fingers, and the second plurality of shuttle contact fingers. The shuttle switch portion exclusively forms an electrical connection between the common contact and the first terminal contact when the drive portion moves the shuttle to a first position along the motion axis. The shuttle switch portion exclusively forms an electrical connection between the common contact and the second terminal contact when the drive portion moves the shuttle to a second position along the motion axis.

The invention also concerns a method for switching an electrical signal. The method begins by forming certain switch components from a plurality of material layers disposed on a substrate. The switch components include a shuttle, a drive portion, a common contact and first and second terminal contacts. The shuttle has an elongated length which extends over the substrate and is resiliently supported at opposing ends thereof. The drive portion is configured to selectively move the shuttle along a motion axis in two opposing directions aligned with the shuttle in response to an applied voltage. A shuttle switch portion is provided at a location along the elongated length including a first switch element formed of a first plurality of shuttle contact fingers extending transversely from opposing sides of the shuttle, and a second shuttle switch element electrically isolated from the first switch element and formed of a second plurality of shuttle contact fingers extending transversely from opposing sides of the shuttle. The common contact is fixed relative to the substrate and is situated adjacent a common terminal side of the shuttle. The first and second terminal contacts are also fixed relative to the substrate but are situated adjacent a switched terminal side of the shuttle.

The method further involves selectively exclusively forming with the shuttle switch portion an electrical connection between the common contact and the first terminal contact when the drive portion applies a first electrostatic force to moves the shuttle in a first direction from a rest position to a first position along the motion axis. The method also includes forming an electrical connection between the common contact and the second terminal contact when the drive portion applies a second electrostatic force to move the shuttle in a second direction from the rest position to a second position along the motion axis.

BRIEF DESCRIPTION OF THE DRAWINGS

Embodiments will be described with reference to the following drawing figures, in which like numerals represent like items throughout the figures, and in which.

DETAILED DESCRIPTION

The invention is described with reference to the attached figures. The figures are not drawn to scale and they are provided merely to illustrate the instant invention. Several aspects of the invention are described below with reference to example applications for illustration. It should be understood that numerous specific details, relationships, and methods are set forth to provide a full understanding of the invention. One having ordinary skill in the relevant art, however, will readily recognize that the invention can be practiced without one or more of the specific details or with other methods. In other instances, well-known structures or operation are not shown in detail to avoid obscuring the invention. The invention is not limited by the illustrated ordering of acts or events, as some acts may occur in different orders and/or concurrently with other acts or events. Furthermore, not all illustrated acts or events are required to implement a methodology in accordance with the invention.

The figures depict a MEMS switch 10. The switch 10 can selectively establish and disestablish electrical contact between a common component and a first and second electronic component (not shown). In other words, the switch is of the single pole, double throw variety. The switch 10 has a maximum height ("z" dimension) of approximately 0.2 mm; a maximum width ("y" dimension) of approximately 1.0 mm; and a maximum length ("x" dimension) of approximately 1.6 mm. The switch 10 is described as a MEMS switch having these particular dimensions for exemplary purposes only. Alternative embodiments of the switch 10 can be scaled up or down in accordance with the requirements of a particular application, including size, weight, and power (SWaP) requirements.

Figure 1:
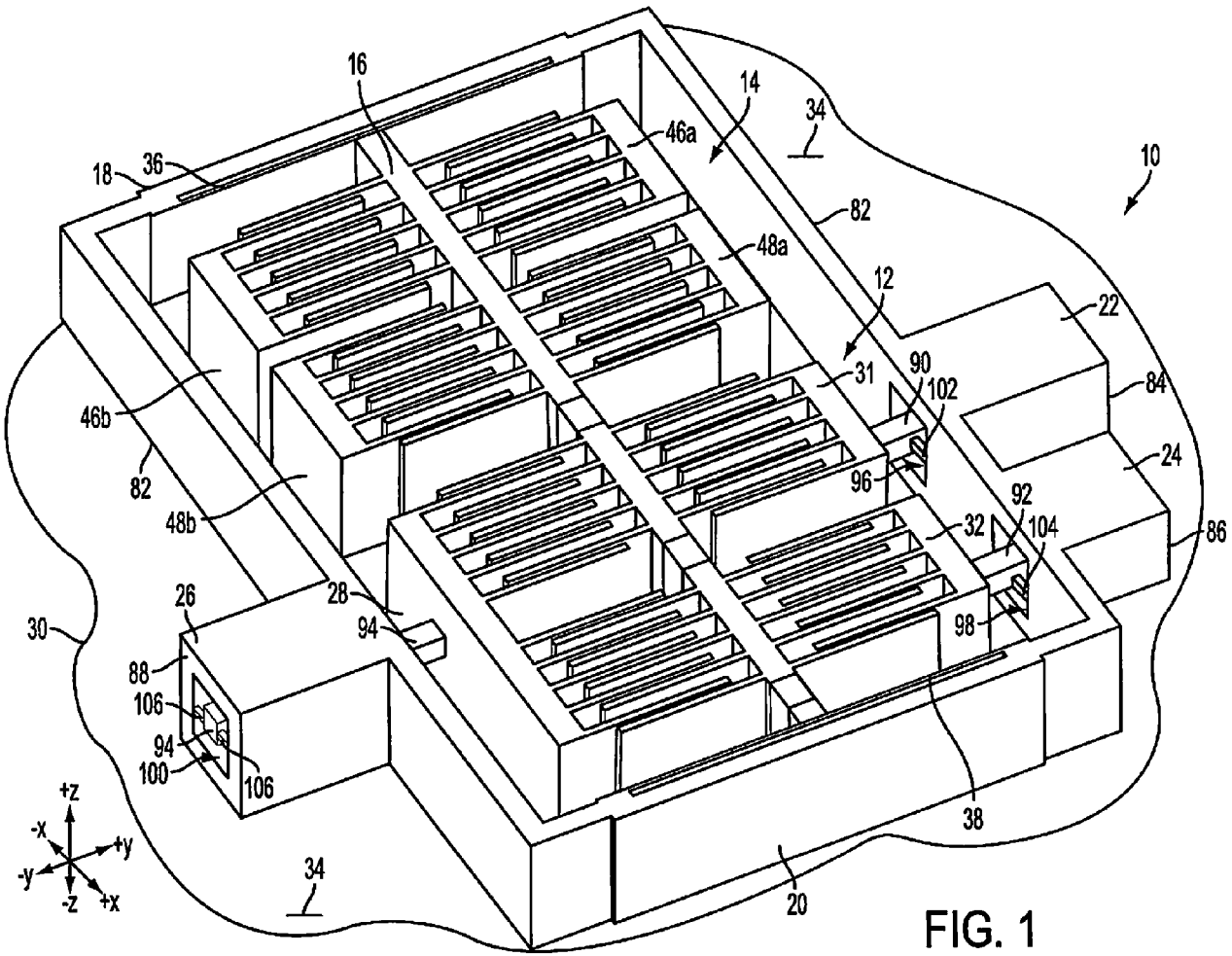
FIG. 1 is a perspective view of a switch that is useful for understanding the invention.

The switch 10 comprises a contact portion 12, a drive portion 14, and a shuttle 16, as shown in FIG. 1. The shuttle 16 is resiliently suspended over a substrate 30 by first and second opposing base members 18 and 20. The first and second electronic components are electrically connected to the contact portion 12 by means of transition portions 22, 24, which can be formed as coaxial transmission lines. The common electrical component is electrically connected to the contact portion 12 by means of transition portion 26. Transition portion 26 can also be formed as a coaxial transmission line. More particularly the common electrical component is connected by transition portion 26 to common contact 28, the first component is electrically connected by transition portion 22 to the first terminal contact 31, and the second component is electrically connected by transition portion 24 to the second terminal contact 32. Each of the common contact, first terminal contact and second terminal contact are fixed in position with respect to said substrate.

As discussed below, the shuttle 16 moves in the "x" direction between a first position, a second position and a rest position, in response to selective energization and de-energization of certain motive elements included in the drive portion 14. The shuttle 16 selectively facilitates the flow of electric current through the contact portion 12 when the shuttle 16 is in its first or second position. In the first position, the shuttle facilitates the flow of electrical current between the common contact 28 and the first terminal contact 31. In the second position, the shuttle facilitates the flow of electrical current between the common contact 28 and the second terminal contact 32. The first terminal contact is always electrically isolated from the second terminal contact. Current does not flow through the shuttle 16 when it is in its rest position. Thus, the first and second electronic components are both electrically isolated from the common component when the shuttle 16 is in its rest position.

Figure 2:
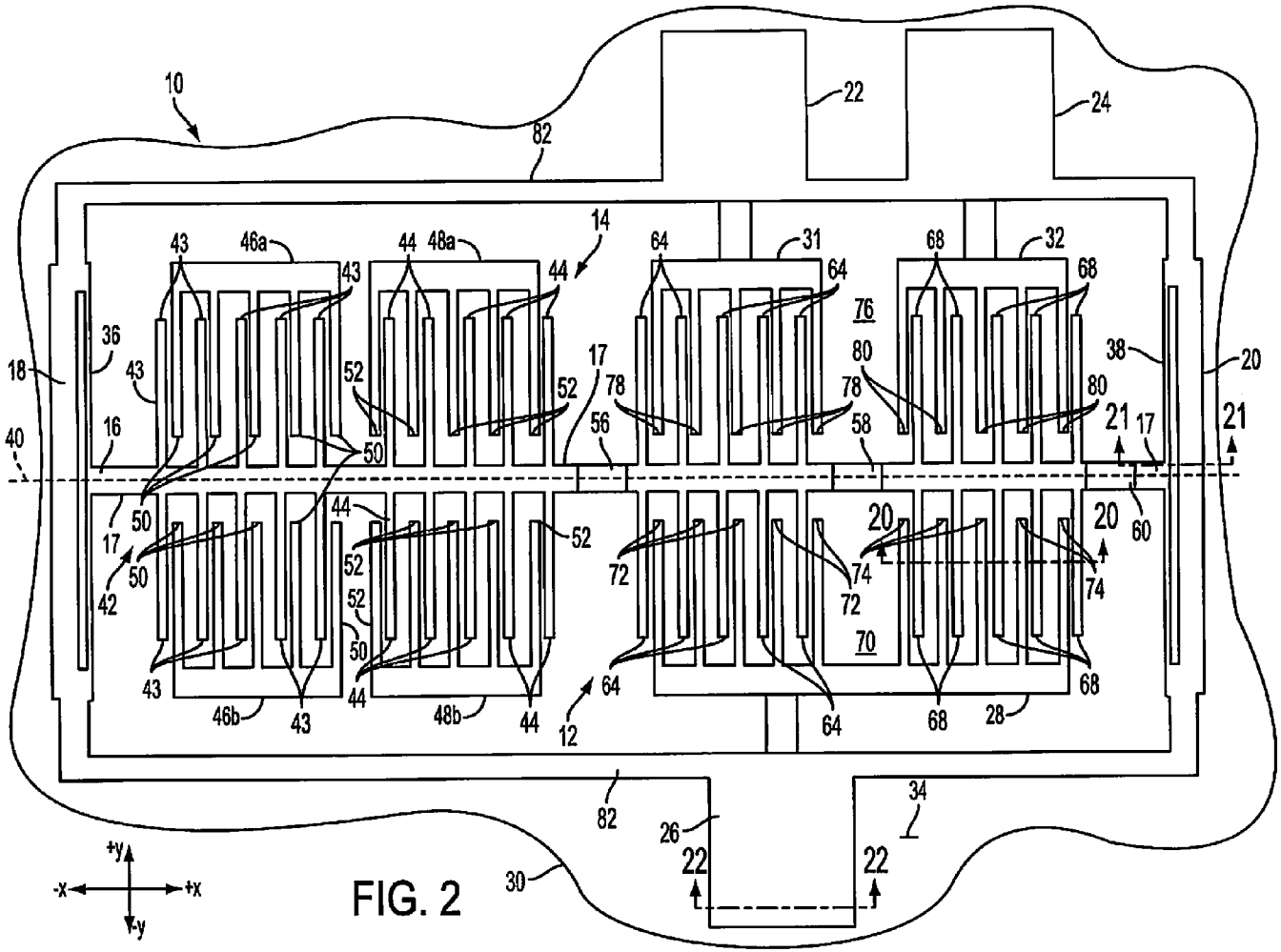
FIG. 2. is a top view of the switch in FIG. 1 with the shuttle in a rest position.

The switch 10 comprises a substrate 30 formed from a dielectric material such as silicon (Si), as shown in FIGS. 1 and 2. The substrate 30 can be formed from other materials, such as glass, silicon-germanium (SiGe), or gallium arsenide (GaAs) in alternative embodiments. The switch 10 also includes a ground plane 34 disposed on the substrate 30. The switch 10 is formed from five or more layers of an electrically-conductive material such as copper (Cu). Each layer can have a thickness of, for example, approximately between 10 μm to 50 μm. Other different ranges of layer thickness are also possible. For example, in some embodiments, the conductive material layers can range in thickness from between 50 μm to 150 μm or between 50 μm to 200 μm.

The switch can also include one or more layers of dielectric material as may be necessary to form electrically insulating portions of the switch. These dielectric material portions are used to isolate certain portions of the switch from other portions of the switch and/or from the ground plane 34. The dielectric material layers described herein will generally have a thickness of between 1 μm to 20 μm but can also range between 20 μm to 100 μm. The thickness and number of the layers of electrically-conductive material and dielectric material is application-dependent, and can vary with factors such as the complexity of the design, hybrid or monolithic integration of other devices, the overall height ("z" dimension) of the various components, and so on. According to one aspect of the invention, the switch can be formed using techniques similar to those described in U.S. Pat. Nos. 7,012,489 and 7,898,356.

As may be observed in FIGS. 1 and 2, the shuttle 16 has an elongated length formed by beam 17 which extends in the "x" direction over the substrate 34. Except as otherwise noted herein, the shuttle is formed of a conductive material, such as copper (Cu). The shuttle is resiliently supported at opposing first and second ends thereof by first and second resilient members 36, 38 respectively. The resilient members are provided (e.g. integrally formed with) first and second opposing base members 18, 20. The base members and the resilient members can also be formed of copper. In an embodiment of the invention, the resilient members 36, 38 can be formed as thin reed-like structures which are capable of flexing in the "x" direction. Still, the invention is not limited to reed-like structures and any other resilient structure can also be used provided that it is capable of supporting the shuttle over the substrate and allowing the shuttle to move in the +/−x direction as hereinafter described. The shuttle is preferably supported just above the surface of the substrate so that it can move freely along motion axis 40 subject to the constraints of resilient members 36, 38. The drive portion 14 is designed to selectively apply one of two opposing forces which move the shuttle 16 along the motion axis 40 in response to an applied voltage. The operation of the drive portion will become more apparent as the detailed description of its structure progresses.

Figure 3:
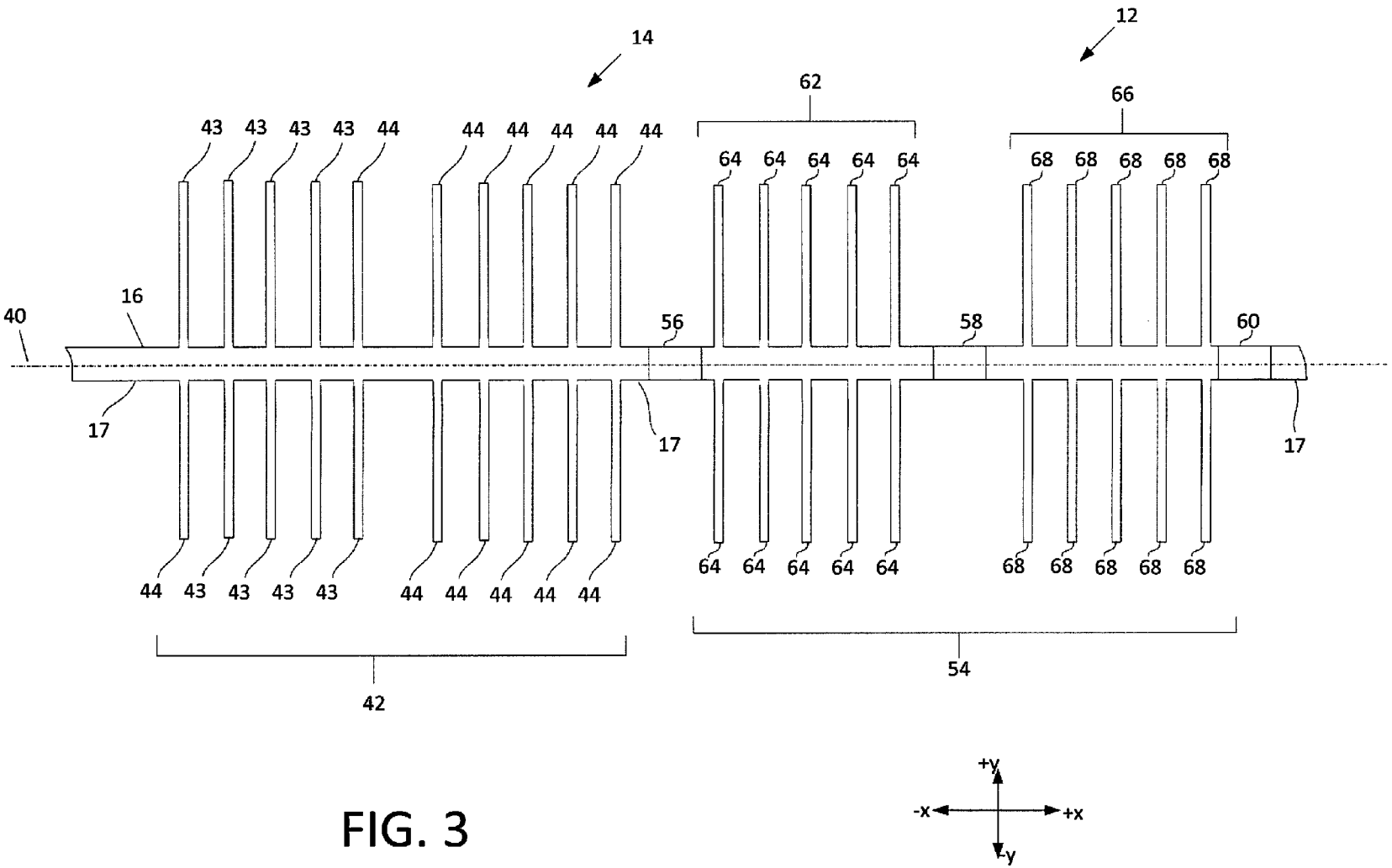
FIG. 3 is a top view of the shuttle used in the switch of FIG. 1.

As shown in FIGS. 2 and 3, the drive portion 14 includes a shuttle drive portion 42 which is provided at a first location along the elongated length of the shuttle. The shuttle drive portion 42 includes a first plurality of shuttle drive fingers 44, and a second plurality of shuttle drive fingers 43. The first and second plurality of shuttle drive fingers extend transversely (in the +/−y directions) from opposing sides of the shuttle. As shown in FIG. 2, a plurality of electrodes 46*a*, 46*b*, 48*a*, 48*b* are fixed in position relative to the substrate 30 on opposing sides of the shuttle drive portion. In an embodiment of the invention, the electrodes are formed on the surface of substrate 30. Each of the electrodes includes a plurality of motive drive fingers. More particularly, electrodes 48*a*, 48*b* comprise a plurality of first position motive drive fingers 52 which are respectively interdigitated with the first plurality of shuttle drive fingers 44 as shown. Similarly, electrodes 46*a*, 46*b* comprise a plurality of second position motive drive fingers 50 which are interdigitated with the second plurality of shuttle drive fingers 43 as shown. Suitable electrical connections (not show) are provided so that electrodes 48*a*, 48*b* can be simultaneously excited with an actuation voltage. Similarly, electrical connections are provided so that electrodes 46*a*, 46*b* can be simultaneously excited with an actuation voltage.

the first position and second position motive drive fingers 52, 50 are spaced an unequal distance between adjacent ones of the shuttle drive fingers 44, 43 when the shuttle is in its rest position shown in FIG. 2. In other words, individual ones of the first plurality of motive drive fingers 52 are not centered between adjacent ones of the first plurality of shuttle drive fingers 44. Similarly, individual ones of the second plurality of motive drive fingers 50 are not centered between adjacent ones the second plurality of shuttle drive fingers 43. The purpose of this off-center spacing is to ensure that an electrostatic force applied to the shuttle 16 by the motive drive fingers 50, 52 of a particular electrode will be greater in one direction along the motion axis 40 as compared to the opposite direction.

For example, when a voltage potential is established between the shuttle drive portion 42 and first position motive drive finger 52, an electrostatic force will be exerted on shuttle drive fingers 44. The force exerted on each shuttle drive finger closest to a first position motive drive finger 52 will be greater as compared to the force exerted on a shuttle drive finger 44 which is located on an opposing side of the same first position motive drive finger 52, but spaced a greater distance away. Accordingly, a net force will be exerted upon the shuttle, thereby causing it to move. It will be appreciated that if the first position motive drive finger 52 was equally spaced between adjacent shuttle drive fingers 44, it would exert an equal but opposite electrostatic force on each of the adjacent shuttle drive fingers and the shuttle would not move. Accordingly, a net force will be applied to the shuttle 16 in a first motion direction when a voltage is applied to first position motive drive fingers 52, which force will cause the shuttle to move in a +x direction along the motion axis 40. Similarly, a net force will be applied to the shuttle 16 in an opposite direction when a voltage is applied to the second position motive drive fingers 50, which force will cause the shuttle to move in an opposite (−x) direction along the motion axis 40.

In order to achieve the above-described bi-directional motion, the inter-digital spacing associated with the electrodes 46*a*, 46*b* is intentionally made asymmetric as compared to the inter-digital spacing associated with the electrodes 48*a*, 48*b*. In particular, the spacing from a first position motive drive finger 52 to an adjacent one of the first plurality of shuttle drive fingers 44 is less in the +x direction than it is in the −x direction. Conversely, the spacing from a second position motive drive finger 50 to an adjacent one of the second plurality of shuttle drive fingers 43 is greater in the +x direction than it is in the −x direction. Accordingly, an inter-digital spacing configuration of the first position motive drive fingers 52 relative to the first plurality of shuttle drive fingers 44 is asymmetric as compared to an inter-digital spacing configuration of the second position motive drive fingers 50 relative to the second plurality of shuttle drive fingers 43. This asymmetric inter-digital spacing arrangement ensures that the shuttle 16 will move in the +x direction to a first position (shown in FIG. 4) when a voltage is applied exclusively to electrodes 48*a*, 48*b*. Conversely, the shuttle will move in the −x direction to a second position (shown in FIG. 5) when the voltage is applied exclusively to electrodes 46*a*, 46*b*. When no voltage is applied to electrodes 46*a*, 46*b*, 48*a*, 48*b*, the shuttle will return to its rest position as shown in FIG. 2. Consequently, active bi-direction motion control of the shuttle is obtained with the drive portion arrangement as shown.

As shown in FIG. 3, the shuttle 16 includes a shuttle switch portion 54 provided at a second location along the elongated length of the shuttle. The shuttle switch portion is electrically isolated from the shuttle drive portion 42 by an insulator section 56. The shuttle switch portion is further electrically isolated by means of an insulator portion 60. The insulator portion 60 electrically isolates the shuttle switch portion from the first and second opposing base members 18 and 20. The shuttle switch portion 54 includes a first switch element 62 formed of a first plurality of shuttle contact fingers 64 which extend transversely from opposing sides of a first switch section of the shuttle, and a second shuttle switch element 66 formed of a second plurality of shuttle contact fingers 68 extending transversely from opposing sides of a second switch section of the shuttle. An insulator portion 58 electrically isolates the first switch element 62 from the second switch element 66. The insulator portions 56, 58, and 60 can be formed of a suitable dielectric material such as polyethylene, polyester, polycarbonate, cellulose acetate, polypropylene, polyvinyl chloride, polyvinylidene chloride, polystyrene, polyamide, polyimide, benzocyclobutene, SU8, etc., provided the material will not be attacked by the solvent used to dissolve the sacrificial resist during manufacture of the switch 10 as discussed below.

As shown in FIG. 2, switch 10 includes common contact 28 which has a fixed position relative to the substrate 30. For example, the common contact 28 can be disposed directly on a surface of the substrate. The common contact 28 is disposed on a portion of the substrate which is adjacent to the shuttle on one side thereof, and which shall be referred to herein as a common terminal side 70 of the shuttle. The common contact 28 includes a first plurality of common contact fingers 72 interdigitated with the first plurality of shuttle contact fingers 64 that extend over the common contact terminal side 70 of the substrate. The common contact also includes a second plurality of common contact fingers 74 which are interdigitated with the second plurality of shuttle contact fingers 68 that extend over the common contact terminal side 70 of the substrate.

The switch 10 also includes first and second terminal contacts 31, 32, which are provided in a fixed position relative to the substrate 30. For example, the first and second terminal contacts can be disposed directly on a surface of the substrate. The first and second terminal contacts are disposed on a portion of the substrate adjacent to the shuttle on one side thereof, and which shall be referred to herein as a switched terminal side 76 of the substrate. The first and second terminal contacts 31, 32 comprise a plurality of first terminal contact fingers 78 and a plurality of second terminal contact fingers

80 which are respectively interdigitated with the first plurality of shuttle contact fingers 64, and the second plurality of shuttle contact fingers 68.

Notably, the first plurality of common contact fingers 72 are positioned off-center relative to adjacent ones of the first plurality of shuttle contact fingers 64. As shown in FIG. 2, the common contact fingers 72 are arranged so that the spacing to an adjacent one of the shuttle contact finger 64 is greater in the +x direction as compared to the −x direction. The first terminal contact fingers 78 are similarly offset or off-center in position relative to adjacent ones of the first plurality of shuttle contact fingers 64. In particular, the spacing from a first terminal contact finger 78 to an adjacent one of the shuttle contact fingers 64 is greater in the +x direction as compared to the spacing in the −x direction.

The second plurality of common contact fingers 74 are positioned off-center relative to adjacent ones of the second plurality of shuttle contact fingers 68. As shown in FIG. 2, the second plurality of common contact fingers are arranged so that the spacing to an adjacent one of the shuttle contact fingers 68 is less in the +x direction as compared to in the −x direction. The second terminal contact fingers 80 are similarly offset or off-center in position relative to adjacent ones of the second plurality of shuttle contact fingers 68. In particular, the spacing from a second terminal contact finger 80 to an adjacent one of the shuttle contact fingers 68 is less in the +x direction as compared to the −x direction.

From the foregoing, it can be appreciated that an interdigital spacing configuration of the first plurality of common contact fingers 72 relative to adjacent ones of the first plurality of shuttle contact fingers 64 is asymmetric as compared to an interdigital spacing of the second plurality of common contact fingers 74 relative to adjacent ones of the second plurality of shuttle contact fingers 68. Likewise, it should be appreciated that an interdigital spacing configuration of the first terminal contact fingers 78 relative to adjacent ones of the first plurality of shuttle contact fingers 64, is asymmetric as compared to an interdigital spacing configuration of the second terminal contact fingers 80 relative to adjacent ones of the second plurality of shuttle contact fingers 68. The foregoing asymmetric spacing configuration facilitates bi-directional switch operation as will be explained below in further detail.

As shown in FIGS. 1 and 2, the switch 10 can also include a wall 82 which extends in the +z direction from the surface of the substrate around a periphery of the switch. The wall is disposed on substrate 30 and formed of a conductive material, such as copper (Cu). The wall extends completely or at least substantially around the shuttle 16, electrodes 46*a*, 46*b*, 48*a*, 48*b*, the common contact 28 and the first and second terminal contacts 31, 32. In some embodiments, the first and second opposing base members 18, 20 can be integrated into the peripheral wall 82 as shown, although the invention is not limited in this regard. The wall 82 helps to electrically isolate any electrostatic fields and/or RF energy which may be present on any of the internal components of the switch which are enclosed by the wall. As noted above, the surface of the substrate 30 can include a conductive metal ground plane 34. The conductive metal ground plane 34 is preferably absent in the area of the substrate within the confines of wall 82.

In an embodiment of the invention shown in FIGS. 1-3, an outer shield 84, 86, 88 of transition portions 22, 24, 26 is integrally formed with wall 82 and forms an electrical connection therewith. Each of the transition portions 22, 24, 26 also includes an inner conductor 90, 92, 94, respectively. Each of the inner conductors, 90, 92, 94 extends through a respective opening defined in the wall 82. Inner conductor 90 forms an electrical connection with the first terminal contact 31. Inner conductor 92 forms an electrical connection with the second terminal contact 32. Inner conductor 94 forms an electrical connection with the common contact 28. With the foregoing arrangement RF signals communicated on transition portion 26 can be controlled by the operation of switch 10 so that they are routed to either transition portion 22 or transition portion 24. The RF signal routing will be determined by a position of the shuttle 16 as described herein.

The inner conductors 90, 92, 94 are respectively suspended within an internal channel 96, 98, 100 defined within the outer shield 84, 86, 88 of transition portions 22, 24, 26. The inner conductors are supported within the channel by electrically-insulative tabs 102, 104, 106, as illustrated in FIG. 1. The tabs 102, 104, 106 are formed from a dielectric material. For example, the tabs can be formed from polyethylene, polyester, polycarbonate, cellulose acetate, polypropylene, polyvinyl chloride, polyvinylidene chloride, polystyrene, polyamide, polyimide, benzocyclobutene, SU8, etc., provided the material will not be attacked by the solvent used to dissolve the sacrificial resist during manufacture of the switch 10 as discussed below. The tabs 102, 104, 106 can each have a thickness of, for example, approximately 15 μm. Each tab spans the width, i.e., x-direction dimension, of the channel 96, 98, 100. The ends of each tab are sandwiched between layers of electrically-conductive material that form the sides of the ground housing outer shields 84, 86, 88. The inner conductors 90, 92, 94 are surrounded by, and are spaced apart from the interior surfaces of the outer shields 84, 86, 88 by an air gap. The air gap acts as a dielectric that electrically isolates the inner conductors 90, 92, 94 from the outer shield. The type of transmission-line configuration shown and described herein with respect to FIG. 2 is commonly referred to as a "recta-coax" configuration, otherwise known as micro-coax.

Figure 4:
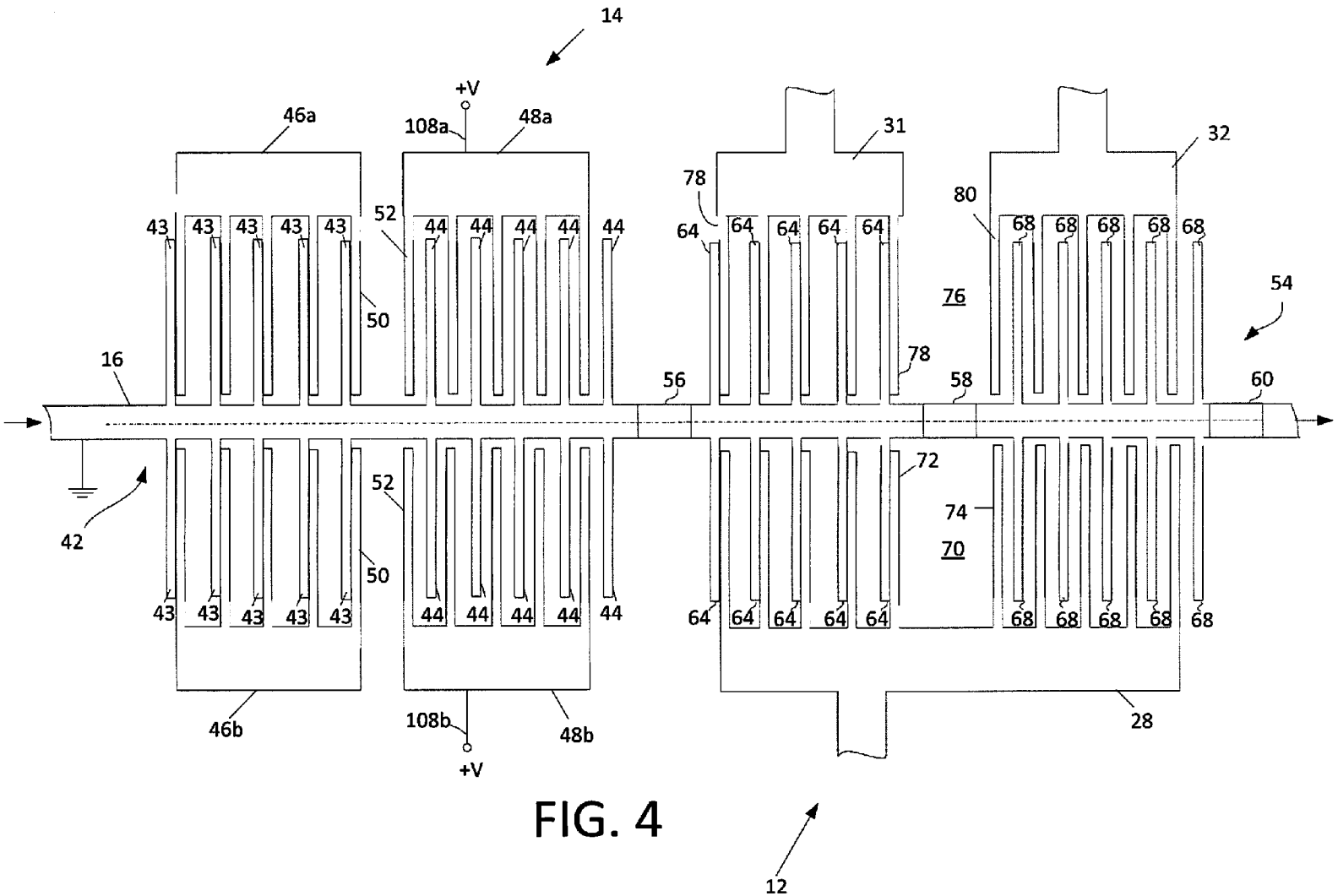
FIG. 4 is a top view of a portion of the switch in FIG. 1, with the shuttle in a first switch position.

The operation of the switch 10 will now be described in further detail with reference to FIGS. 4 and 5. As shown in FIG. 4, a voltage difference is established between electrodes 48*a*, 48*b* and the shuttle drive portion 42. For example, in the embodiment shown a voltage +V is applied to each of the electrodes 48*a*, 48*b* by means of first and second leads 108*a*, 108*b*, and the shuttle drive portion 42 is connected to ground (e.g. ground plane 34) as shown. An exemplary voltage source providing +V would be a 120-volt direct current (DC) voltage source (not shown). The ground plane 34 of the substrate is electrically isolated from the electrodes 48*a*, 48*b*. When a voltage is applied in this way, an electrostatic potential is generated between each of the first position motive fingers 52 and adjacent ones of the first plurality of shuttle drive fingers 44. The electrostatic potential causes a force to be applied to the first plurality of shuttle drive fingers 44, which urges the shuttle 16 in the +x direction to the first position as shown. Consequently, the first plurality of shuttle contact fingers 64 are caused to come into contact with the first plurality of common contact fingers 72. Concurrently, the first plurality of shuttle contact fingers 64 are also caused to come into contact with the first terminal contact fingers 78. Accordingly, the shuttle switch portion 54 forms an electrical connection between the common contact 28 and the first terminal contact 31 when in the first position. Notably, when the shuttle is in this first position, the second plurality of shuttle contact fingers 68 are spaced between adjacent ones of the second plurality of common contact fingers 74, and are also spaced between the second plurality of terminal contact fingers 80. The air within the gaps between the shuttle contact fingers 68 and the common contact fingers 74, and the air between the shuttle contact fingers 68 and the plurality of terminal contact fingers 80 acts as a dielectric insulator that electrically isolates the adjacent fingers from each other when the shuttle 16 is in the first position. Accordingly, no electrical contact is formed between the common contact 28 and the second terminal contact 32 when the shuttle is in its first position.

Figure 5:
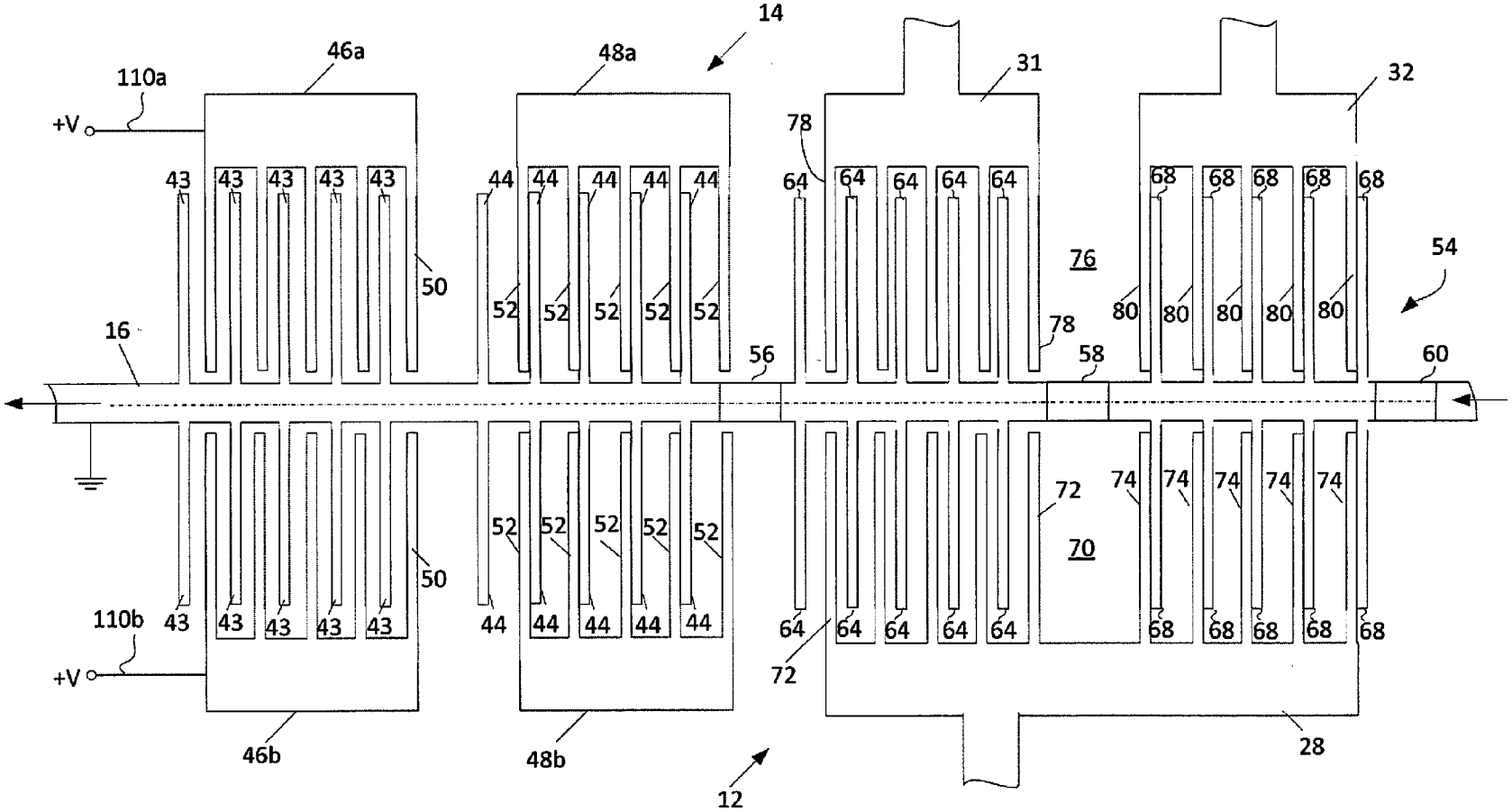
FIG. 5 is a top view of a portion of the switch in FIG. 1, with the shuttle in a second switch position.

Referring now to FIG. 5, the shuttle 16 is shown in its second position. To move the shuttle to the second position, a voltage difference is established between each of the electrodes 46*a*, 46*b*, and the shuttle drive portion 42. For example, in the embodiment shown a voltage +V is applied to each of the electrodes 46*a*, 46*b* by means of first and second leads 110*a*, 110*b*, and the shuttle drive portion 42 is connected to ground (e.g. ground plane 34) as shown. An exemplary voltage source providing +V would be a 120-volt direct current (DC) voltage source (not shown). When a voltage is applied in this way, an electrostatic potential is generated between each of the second position motive fingers 50 and adjacent ones of the second plurality of shuttle drive fingers 43. The electrostatic potential causes a force to be applied to the second plurality of shuttle drive fingers 43, which urges the shuttle 16 in the −x direction to the second position as shown. Consequently, the second plurality of shuttle contact fingers 68 are caused to come into contact with the second plurality of common contact fingers 74. Concurrently, the second plurality of shuttle contact fingers 68 are also caused to come into contact with the second terminal contact fingers 80. Accordingly, the shuttle switch portion 54 forms an electrical connection between the common contact 28 and the second terminal contact 31 when in the second position. Notably, when the shuttle is in this second position, the first plurality of shuttle contact fingers 64 are spaced between adjacent ones of the first plurality of common contact fingers 72, and are also spaced between the first plurality of terminal contact fingers 78. The air within the gaps between the shuttle contact fingers 64 and the common contact fingers 72, and the air between the shuttle contact fingers 64 and the plurality of terminal contact fingers 78 acts as a dielectric insulator that electrically isolates the adjacent fingers from each other when the shuttle 16 is in the second position. Accordingly, no electrical contact is formed between the common contact 28 and the first terminal contact 31 when the shuttle is in its second position.

As will be appreciated from the foregoing description, the shuttle 16 will move a certain deflection distance along the motion axis (relative to the rest position of the shuttle) when a voltage is applied as described herein. The relationship between the deflection distance and the voltage applied is dependent upon the stiffness of the first and second resilient members 36, 38, which in turn is dependent upon factors that include the shape, length, and thickness of the resilient members, and the properties, e.g., Young's modulus, of the material from which the resilient members are formed. These factors can be tailored to a particular application so as to minimize the required actuation voltage, while providing sufficient strength for supporting the shuttle in a particular application; with sufficient stiffness to tolerate the anticipated levels shock and vibration; and with sufficient resilience to facilitate the return of the shuttle 16 to its open position when the voltage potential applied to the drive portion is removed. Those skilled in the art will appreciate that drive portion 14 can have a configuration other than that described herein. For example, suitable comb, plate, or other types of electrostatic actuators can be used in the alternative.

The construction of switch 10 will now be described in further detail. The switch 10 and alternative embodiments thereof can be manufactured using known processing techniques for creating three-dimensional microstructures, including coaxial transmission lines. For example, the processing methods described in U.S. Pat. Nos. 7,898,356 and 7,012,489 can be used for this purpose, and the disclosure of those references is incorporated herein by reference. The construction of the switch will be described with respect to FIGS. 6-21 which show various cross-sectional views of the construction as taken along lines 6-6 and 7-7 in FIG. 2.

Figure 6:
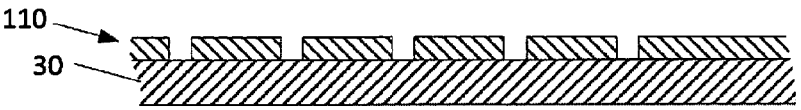
FIGS. 6-19 are a series of drawings which are useful for understanding a method of constructing the switch in FIG. 1.
Figure 7:
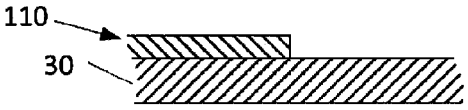
Figure 8:
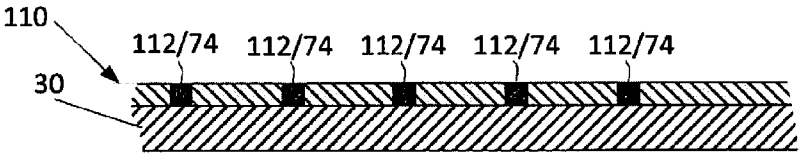
Figure 9:
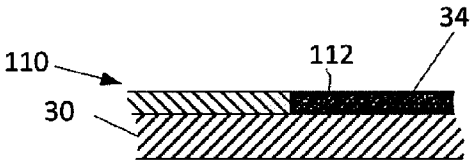

As shown in FIGS. 6 and 7, a first photoresist layer 110 formed of a dielectric material is applied to the upper surface of the substrate 30 so that the exposed portions of the upper surface correspond to the locations at which the conductive material is to be provided. The first photoresist layer is formed, for example, by depositing and patterning photodefinable, or photoresist material on the upper surface of the substrate 30. As shown in FIGS. 8 and 9, the first layer of electrically-conductive material 112 is subsequently deposited on the exposed, portions of the substrate 30 to a predetermined thickness. Conductive material layer 112 forms the first layer of common contact 28, including the second plurality of common contact fingers 74 as shown. The conductive material layer 112 also forms the first layer of: electrodes 46*a*, 46*b*, 48*a*, 48*b*, first and second terminal contacts 31, 32, base members 18 and 20, wall 82 and outer shields 84, 86, 88. As shown in FIG. 9, the conductive material layer 112 also forms the ground plane layer 34. The deposition of the electrically-conductive material is accomplished using a suitable technique such as chemical vapor deposition (CVD). Other suitable techniques, such as physical vapor deposition (PVD), sputtering, or electroplating, can be used in the alternative. The upper surfaces of the newly-formed first layer can be planarized using a suitable technique such as chemical-mechanical planarization (CMP).

Figure 10:
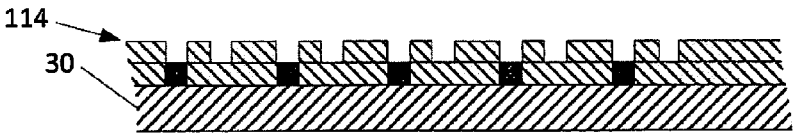
Figure 11:
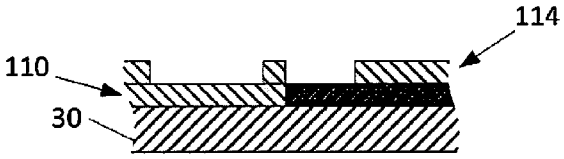
Figure 13:
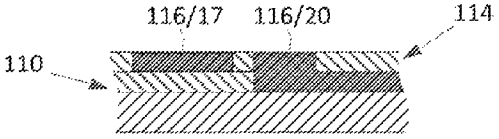
Figure 15:
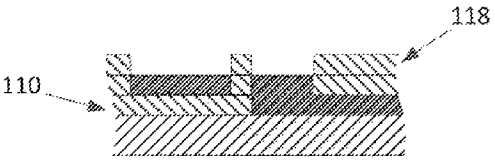
Figure 17:
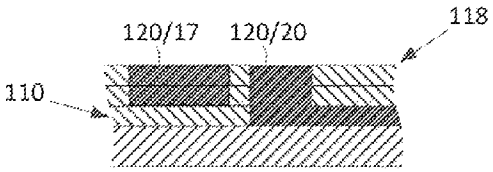
Figure 12:
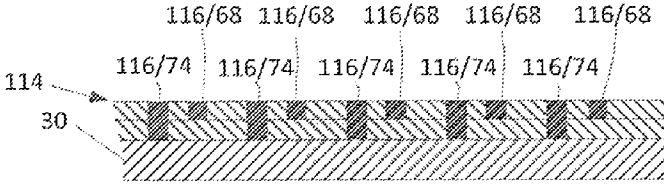
Figure 14:
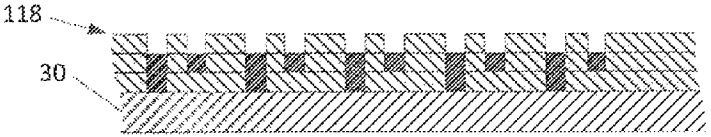
Figure 16:
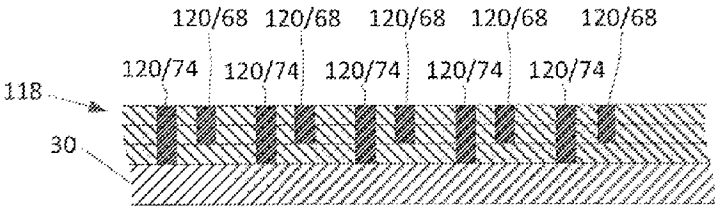

A second layer of photoresist material 114 is deposited and patterned as shown in FIGS. 10 and 11. Thereafter, a second layer of the electrically conductive material 116 is deposited as shown in FIGS. 12 and 13. The second layer of electrically conductive material 116 forms the second layer of common contact 28, including the second plurality of common contact fingers 74 as shown. The conductive material layer 116 also forms the second layer of: electrodes 46*a*, 46*b*, 48*a*, 48*b*, first and second terminal contacts 31, 32, base members 18 and 20, wall 82 and outer shields 84, 86, 88. The second conductive material layer 116 also forms portions of the shuttle 16 including the second plurality of shuttle contact fingers 68. Other portions of the shuttle formed by conductive material layer 116 include: beam 17, the first plurality of shuttle contact fingers 64, first and second plurality of shuttle drive fingers 43, 44.

Figure 19:
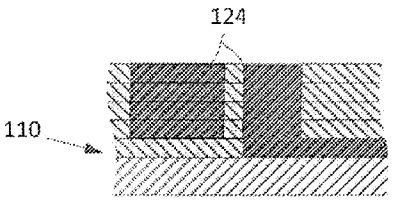
Figure 18:
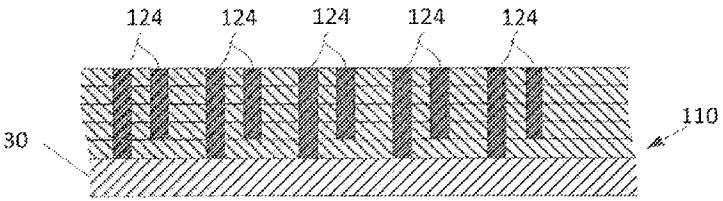

The foregoing process of applying photoresist and conductive material layers is repeated as shown in FIGS. 14-17 by adding a third layer of photoresist 118 and a third layer of conductive material 120. This process adding layers of photoresist and layers of conductive material continues until the structure in FIGS. 18 and 19 is obtained. The third, fourth and fifth layers 120, of conductive material form additional portions of: shuttle 16, electrodes 46*a*, 46*b*, 48*a*, 48*b*, common contact 28, first and second terminal contacts 31, 32, base members 18 and 20, wall 82, inner conductors 90, 92, 94 and outer shields 84, 86, 88.

Figure 21:
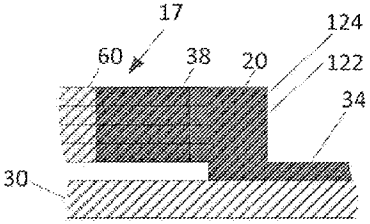
FIG. 21 is a cross-sectional view of the switch in FIG. 2, taken along line 21-21.
Figure 20:
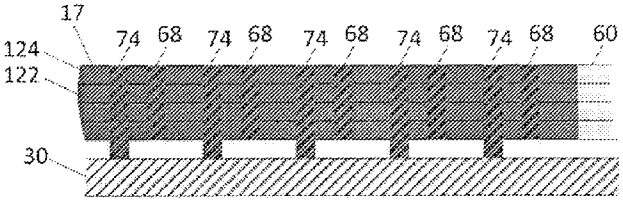
FIG. 20 is a cross-sectional view of the switch in FIG. 2, taken along line 20-20.

Additional layers of photoresist and conductive material can be deposited as required for a particular switch application. After the final layer has been deposited, the photoresist material remaining from each of the masking steps is released or otherwise removed as depicted in FIGS. 20 and 21, using a suitable technique. For example, the photoresist can be removed by exposure to an appropriate solvent that dissolves the photoresist material. The removal of the photoresist undercuts the areas of the shuttle 17 supported on layer 110. The removal of the photoresist also dissolves the dielectric material from the space between base member 18 and resilient member 36, and the space between resilient member 38 and base member 20, thereby freeing shuttle 16 to move along motion axis 40. Notably, the dielectric material layers forming tabs 102, 104, 106, insulator portions 56, 58, and 60 is not removed by the solvent. The dielectric material used for the tabs, insulation portions, etc. is not the same photoresist material used to build the layers up. Thus, the dielectric material must have properties that is not compatible with the solvent used to dissolve the photoresist.

Figure 23:
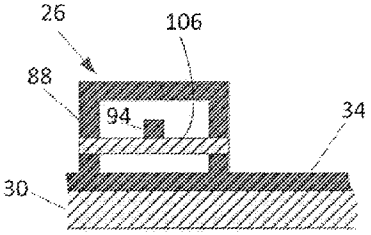
FIG. 23 is a cross-sectional view of the switch in FIG. 2, taken along line 22-22, after the photo-resist layers have been dissolved.
Figure 22:
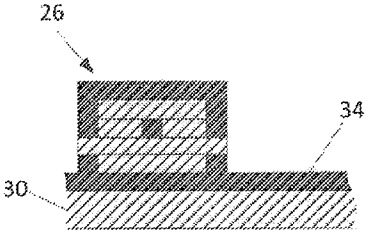
FIG. 22 is a cross-sectional view of the switch in FIG. 2, taken along line 22-22, which is useful for understanding the construction of a transmission line section.

There is shown in FIG. 22 a cross-section view of transition portion 26, taken along line 22-22, after all conductive material layers and dielectric material layers have been deposited as described herein. There is shown in FIG. 23 a cross-sectional view of transition portion 26, taken along line 22-22, after the removal of the photoresist areas. Note that the dielectric material forming the tab 106 is intentionally allowed to remain and is not dissolved by the solvent. Accordingly, the inner conductor 94 is supported within the channel 100 defined by the outer conductive shield 88.

Although the invention has been illustrated and described with respect to one or more implementations, equivalent alterations and modifications will occur to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application. Thus, the breadth and scope of the present invention should not be limited by any of the above described embodiments. Rather, the scope of the invention should be defined in accordance with the following claims and their equivalents.

I claim:

1. A MEMS switch, comprising:

first and second opposing base members formed on a substrate;

first and second resilient members provided respectively at said first and second opposing base members;

a shuttle having an elongated length which extends over said substrate and is resiliently supported at opposing first and second ends thereof by said first and second resilient members respectively;

a drive portion configured to selectively move said shuttle along a motion axis aligned with said elongated length in response to an applied voltage, said drive portion comprised of a shuttle drive portion provided at a first location along said elongated length including a plurality of shuttle drive fingers extending transversely from opposing sides of said shuttle, and a plurality of motive drive fingers interdigitated with said plurality of shuttle drive fingers, said motive drive fingers fixed with respect to said substrate and disposed on opposing sides of said shuttle drive portion;

a shuttle switch portion provided at a second location along said elongated length, electrically isolated from said shuttle drive portion and from said first and second opposing base members, said shuttle switch portion including a first switch element formed of a first plurality of shuttle contact fingers extending transversely from opposing sides of a first switch section of said shuttle, and a second shuttle switch element formed of a second plurality of shuttle contact fingers extending transversely from opposing sides of a second switch section of said shuttle;

a common contact having a fixed position relative to said substrate and disposed on a common terminal side of said shuttle, said common contact comprising a first and second plurality of common contact fingers respectively interdigitated with said first plurality of shuttle contact fingers and said second plurality of shuttle contact fingers;

first and second terminal contacts fixed on a portion of said substrate adjacent to a switched terminal side of said shuttle and comprising first terminal contact fingers and second terminal contact fingers respectively interdigitated with said first plurality of shuttle contact fingers, and said second plurality of shuttle contact fingers; and wherein said shuttle switch portion exclusively forms an electrical connection between said common contact and said first terminal contact when said drive portion moves said shuttle to a first position along said motion axis, and exclusively forms an electrical connection between said common contact and said second terminal contact when said drive portion moves said shuttle to a second position along said motion axis.

2. The MEMS switch according to claim 1, wherein said plurality of motive drive finger are comprised of a plurality of first position motive drive fingers and a plurality of second position motive drive fingers, and said first position motive drive fingers are electrically isolated from said second position motive drive fingers.

3. The MEMS switch according to claim 2, wherein said shuttle drive portion is configured to move said shuttle to said first position when a voltage is applied to said first position motive drive fingers, and configured to move to said second position when said voltage is applied to said second position motive drive fingers.

4. The MEMS switch according to claim 3, wherein an interdigital spacing of said first position motive drive fingers relative to said first plurality of said shuttle drive fingers is asymmetric as compared to an interdigital spacing of said second position motive drive fingers and said second plurality of shuttle drive fingers, whereby a first electrostatic force exerted upon said shuttle when said voltage is applied to said first position motive drive fingers is opposed in direction from a second electrostatic force exerted upon said shuttle when said voltage is applied to said second position motive drive fingers.

5. The MEMS switch according to claim 4, wherein said shuttle drive portion is electrically connected to a ground portion of said substrate, electrically isolated from first position motive drive fingers and said second position motive drive fingers.

6. The MEMS switch according to claim 1, wherein an interdigital spacing of said first plurality of common contact fingers relative to adjacent ones of said first plurality of shuttle contact fingers is asymmetric as compared to an interdigital spacing of said second plurality of common contact fingers relative to adjacent ones of said second plurality of shuttle contact fingers.

7. The MEMS switch according to claim 1, wherein an interdigital spacing of said first terminal contact fingers relative to adjacent ones of said first plurality of shuttle contact fingers, is asymmetric as compared to an interdigital spacing of said second terminal contact fingers relative to adjacent ones of said second plurality of shuttle contact fingers.

8. The MEMS switch according to claim 1, wherein said base members, said resilient member and said shuttle are each defined by a plurality of material layers deposited on said substrate.

9. The MEMS switch according to claim 1, further comprising a wall constructed of a plurality of layers of conductive material disposed on said substrate and extending transversely from a major surface of said substrate, said wall substantially enclosing an area containing said shuttle, said first and second terminal contacts, and said common contact.

10. The MEMS switch according to claim 9, further comprising a first, second and third transition portion, each including an outer conductive shield which is formed integral with said wall and each including an inner conductor electrically isolated from said conductive shield which extends through said wall and is respectively connected to one of said common contact, said first terminal contact and said second terminal contact.

11. The MEMS switch according to claim 1, wherein said shuttle has a rest position determined by said first and second resilient members, and said drive portion is configured to exert a first electrostatic force on said shuttle which is arranged to move said shuttle in a first direction from said rest position to said first position along said motion axis, and exerts a second electrostatic force on said shuttle to move said shuttle in a second direction opposed to said first direction, from said rest position to a second position along said motion axis.

12. A MEMS switch, comprising:

first and second opposing base members formed on a substrate;

a shuttle having an elongated length extending over said substrate and resiliently supported at opposing first and second ends thereof by said first and second opposing base members;

a drive portion configured to selectively move said shuttle along a motion axis aligned with said shuttle in response to an applied voltage;

a shuttle switch portion provided at a location along said elongated length including a first switch element formed of a first plurality of shuttle contact fingers extending transversely from opposing sides of a first switch section of said shuttle, and a second shuttle switch element formed of a second plurality of shuttle contact fingers extending transversely from opposing sides of a second switch section of said shuttle;

a common contact fixed relative to said substrate and situated adjacent a common terminal side of said shuttle and comprising a first and second plurality of common contact fingers respectively interdigitated with said first plurality of shuttle contact fingers and said second plurality of shuttle contact fingers;

first and second terminal contacts fixed relative to said substrate and situated adjacent a switched terminal side of said shuttle, said first and second terminal contact respectively comprising first terminal contact fingers and second terminal contact fingers, and respectively interdigitated with said first plurality of shuttle contact fingers, and said second plurality of shuttle contact fingers, said first terminal contact electrically isolated from said second terminal contact;

wherein said shuttle switch portion exclusively forms an electrical connection between said common contact and said first terminal contact when said drive portion moves said shuttle to a first position along said motion axis, and exclusively forms an electrical connection between said common contact and said second terminal contact when said drive portion moves said shuttle to a second position along said motion axis.

13. The MEMS switch according to claim 12, further comprising a wall defined by a plurality of layers of conductive material disposed on said substrate and extending transversely from a major surface of said substrate, said wall substantially enclosing an area containing said shuttle, said first and second terminal contacts, and said common contact.

14. The MEMS switch according to claim 13, further comprising a first, second and third transition portion, each including an outer conductive shield which is formed integral with said wall and each including an inner conductor electrically isolated from said conductive shield which extends through said wall and is respectively connected to one of said common contact, said first terminal contact and said second terminal contact.

15. The MEMS switch according to claim 12, wherein an interdigital spacing of said first plurality of common contact fingers relative to adjacent ones of said first plurality of shuttle contact fingers is asymmetric as compared to an interdigital spacing of said second plurality of common contact fingers relative to adjacent ones of said second plurality of shuttle contact fingers.

16. The MEMS switch according to claim 12, wherein an interdigital spacing of said first terminal contact fingers relative to adjacent ones of said first plurality of shuttle contact fingers, is asymmetric as compared to an interdigital spacing of said second terminal contact fingers relative to adjacent ones of said second plurality of shuttle contact fingers.

17. The MEMS switch according to claim 12, wherein said drive portion is comprised of:

a shuttle drive portion provided at a first location along said elongated length including a plurality of shuttle drive fingers extending transversely from opposing sides of said shuttle, and a plurality of motive drive fingers interdigitated with said plurality of shuttle drive fingers, said plurality of motive drive fingers fixed with respect to said substrate and disposed on opposing sides of said shuttle drive portion.

18. The MEMS switch according to claim 17, wherein said plurality of motive drive finger are comprised of a plurality of first position motive drive fingers and a plurality of second position motive drive fingers, and said first position motive drive fingers are electrically isolated from said second position motive drive fingers.

19. The MEMS switch according to claim 18, wherein said shuttle drive portion is configured to move said shuttle to said first position when a voltage is applied to said first position motive drive fingers, and configured to move to said second position when said voltage is applied to said second position motive drive fingers.

20. The MEMS switch according to claim 19, wherein an interdigital spacing of said first position motive drive fingers relative to adjacent ones of said first plurality of said shuttle drive fingers is asymmetric as compared to an interdigital spacing of said second position motive drive fingers relative to adjacent ones of said second plurality of shuttle drive fingers, whereby a first electrostatic force exerted upon said shuttle when said voltage is applied to said first position motive drive fingers is opposed in direction from a second electrostatic force exerted upon said shuttle when said voltage is applied to said second position motive drive fingers.

21. The MEMS switch according to claim 12, wherein said base members, said shuttle, said first and second terminal contacts, and said common contact are each defined by a plurality of material layers deposited on said substrate.

22. The MEMS switch according to claim 12, wherein said shuttle has a rest position determined by first and second resilient members respectively disposed on said first and second base members.

23. The MEMS switch according to claim 22 wherein said drive portion is configured to exert a first electrostatic force on said shuttle which is arranged to move said shuttle in a first direction from said rest position to said first position along said motion axis, and to exert a second electrostatic force on said shuttle to move said shuttle in a second direction opposed to said first direction, from said rest position to a second position along said motion axis.

24. A method for switching an electrical signal, comprising:

forming from a plurality of material layers disposed on a substrate:

a shuttle having an elongated length extending over said substrate and is resiliently supported at opposing ends thereof;

a drive portion configured to selectively move said shuttle along a motion axis in two opposing directions aligned with said shuttle in response to an applied voltage;

a shuttle switch portion provided at a location along said elongated length including a first switch element formed of a first plurality of shuttle contact fingers extending transversely from opposing sides of said shuttle, and a second shuttle switch element electrically isolated from said first switch element and formed of a second plurality of shuttle contact fingers extending transversely from opposing sides of said shuttle;

a common contact fixed relative to said substrate and situated adjacent a common terminal side of said shuttle, said common contact comprises a first and second plurality of common contact fingers respectively interdigitated with said first plurality of shuttle contact fingers and said second plurality of shuttle contact fingers;

first and second terminal contacts fixed relative to said substrate and situated adjacent a switched terminal side of said shuttle, said first and second terminal contacts respectively comprising a first plurality of terminal contact fingers and a second plurality of terminal contact fingers respectively interdigitated with said first plurality of shuttle contact fingers and said second plurality of shuttle contact fingers; and wherein said method comprises selectively exclusively forming with said shuttle switch portion an electrical connection between said common contact and said first terminal contact when said drive portion applies a first electrostatic force to move said shuttle in a first direction from a rest position to a first position along said motion axis, and exclusively forms an electrical connection between said common contact and said second terminal contact when said drive portion applies a second electrostatic force to move said shuttle in a second direction from said rest position to a second position along said motion axis.

25. A MEMS switch comprising:

first and second opposing base members extending transversely away from a surface of a substrate and comprised of a plurality of conductive material layers stacked on said substrate;

a shuttle defined by selected ones of said plurality of conductive material layers which are stacked and arranged to form a beam having an elongated length;

first and second resilient member resiliently supporting opposing ends of said beam to facilitate motion of said beam along a motion axis, said first and second resilient members respectively integrated with said first and second opposing base members and integrated with said shuttle, and formed from selected ones of said plurality of conductive material layers which also form said first and second base members and said shuttle;

a shuttle switch portion including a plurality of shuttle contact fingers extending transversely from opposing sides of the shuttle;

a common contact adjacent one side of the shuttle switch portion, said common contact comprises a first and second plurality of common contact fingers respectively interdigitated with said first plurality of shuttle contact fingers and said second plurality of shuttle contact fingers;

first and second terminal contacts adjacent a second side of the shuttle switch portion opposed from the first side, said first and second terminal contacts respectively comprising a first plurality of terminal contact fingers and a second plurality of terminal contact fingers respectively interdigitated with said first plurality of shuttle contact fingers and said second plurality of shuttle contact fingers; and wherein the shuttle contact fingers are arranged so that said shuttle switch portion selectively connects the common contact to the first terminal contact when said shuttle is in a first position along said motion axis, to the second terminal contact when in a second position along said motion axis, and isolates the common contact from the first and second terminal contact when said shuttle is in a third position along said motion axis.

* * * * *